United States Patent [19]

Lancellotti

[11] 4,233,687

[45] Nov. 18, 1980

[54] SPORTS HELMET WITH FACE MASK

[76] Inventor: William E. Lancellotti, 371 Broadway, Providence, R.I. 02909

[21] Appl. No.: 933,783

[22] Filed: Aug. 14, 1978

[51] Int. Cl.[3] ..... A63B 71/10; A42B 3/00

[52] U.S. Cl. ..... 2/9; 2/424; 2/425

[58] Field of Search ..... 2/9, 425, 424

[56] References Cited

U.S. PATENT DOCUMENTS

| | | | |
|---|---|---|---|
| 3,263,236 | 8/1966 | Humphrey | 2/9 |
| 3,608,089 | 9/1971 | Abbatelli | 2/9 |
| 3,889,296 | 6/1975 | Martin | 2/9 |

*Primary Examiner*—Louis Rimrodt
*Attorney, Agent, or Firm*—Salter & Michaelson

[57] ABSTRACT

A combination sports helmet and face mask construction is disclosed in which a mask of grid-like configuration having a peripheral base portion is attached to the helmet in a novel manner. In one embodiment of the invention, the attachment means includes a plurality of spaced blocks each including a forwardly directed undercut opening for receipt of the base portion of the mask. In another embodiment, the attachment means includes an element secured to the mask about the periphery of the frontal opening thereof such that the base portions of the mask may be disposed proximal thereto. In such latter embodiment, the attachment of the mask to the helmet is by means of a plurality of headed members received within recessed pockets. The pockets may be formed either in the base portion of the mask or in the peripheral element of the helmet. In all cases, the mask is received by the helmet in a snap frictional engagement such that the mask may be completely removed therefrom, i.e. "broken away" when strenuously grasped by an opponent during athletic play so as to reduce the likelihood of twist-type injury to the neck or head of the wearer.

1 Claim, 8 Drawing Figures

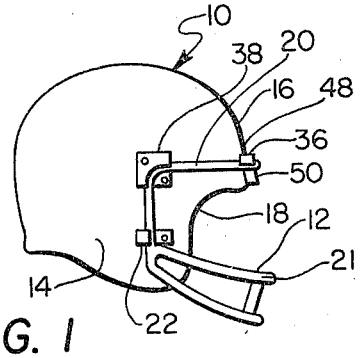
FIG. 1
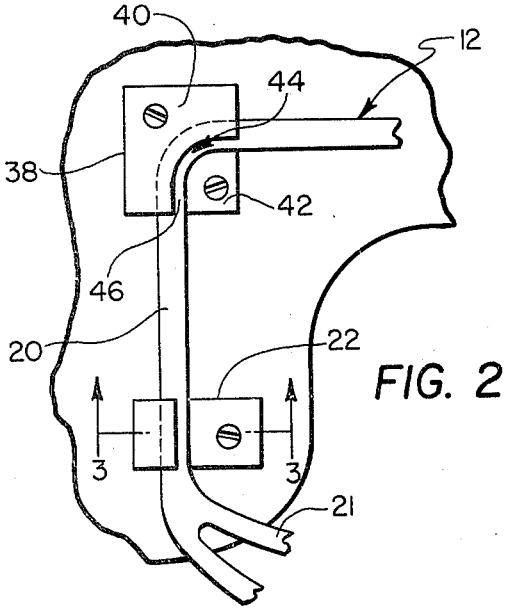
FIG. 2
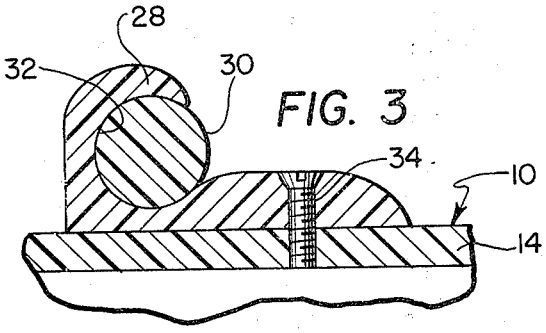
FIG. 3
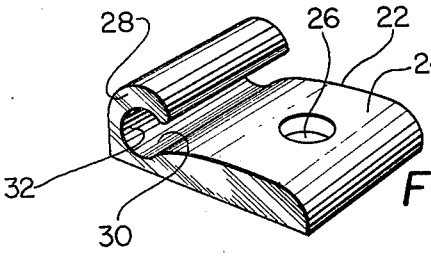
FIG. 4
FIG. 5
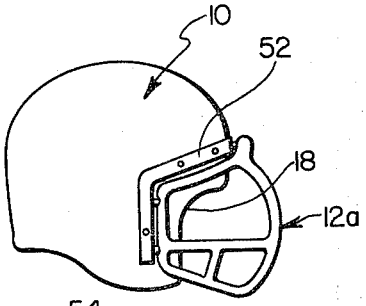
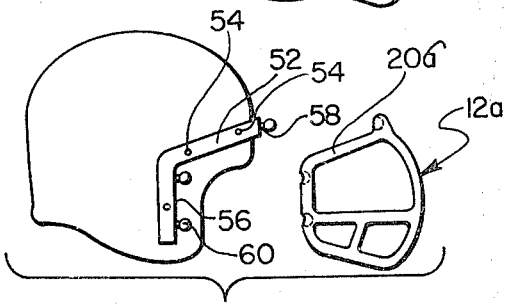
FIG. 6
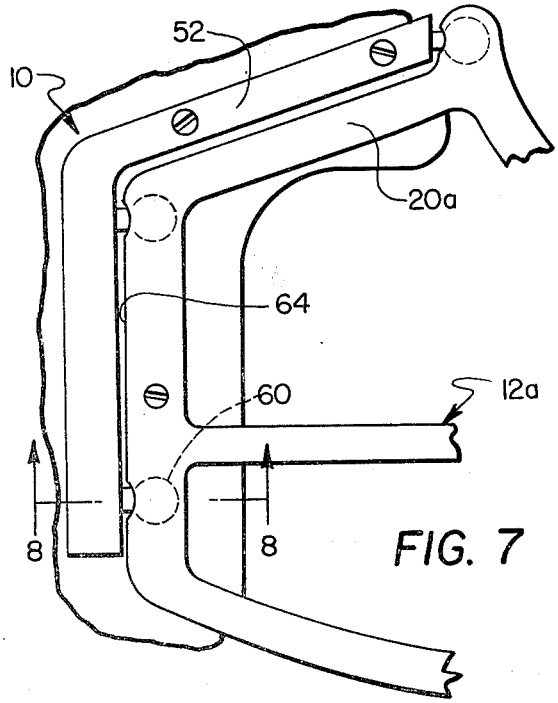
FIG. 7
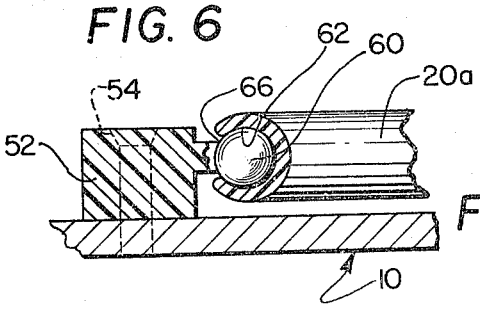
FIG. 8

SPORTS HELMET WITH FACE MASK

BACKGROUND AND SUMMARY OF THE INVENTION

This invention relates to a safety device for use with a protective sports helmet and more particularly to a football type helmet having a fully break-away face mask portion. Modern football helmets now generally include an outwardly extending face mak permanently connected to the helmet in such a manner so as to protect the face of the wearer from injury during maneuvers associated with such sport. However, with the introduction and common use of such face mask construction there has been a consequential rise in neck injuries caused by opponents' grasping the face mask portion of the helmet in attempts to tackle or otherwise displace the position of the wearer. Generally, injuries of this type are caused by a twisting motion imparted to the head and subsequently the wearer's neck.

This drawback has been recognized and attempts have been made to provide helmets which eliminate or reduce such effect. Accordingly, helmet face guard combinations in which the face guard is somewhat resiliently mounted so as to absorb shock or distort upon being grasped are shown in U.S. Pat. No. 3,170,164. Other attempts to alleviate the above-indicated problem include the provision of a pivotal face guard such as set forth in U.S. Pat. No. 3,139,624 or a fully break-away face guard as disclosed in U.S. Pat. No. 3,283,336. The citation of the above-indicated patents along with the discussion thereof constitutes applicant's Prior Art Disclosure and in that regard, a copy of each such patent is enclosed with this application.

Such prior art attempts to alleviate the above-discussed problems have not, however, met with complete success, and accordingly the need still exists for a face mask helmet combination which effectively reduces the above-discussed type of neck injury. It is accordingly a primary object of the present invention to provide a safety device for use with a protective sports helmet including an open grid-like mask adapted to be connected thereto but fully removable therefrom when grasped by another player no matter what the direction of the pull may be.

A further object of the present invention is the provision of a safety device of the aforementioned type in which the mask portion thereof is normally engaged with the helmet by a frictional snap lock in a relatively uncomplicated fashion and which does not alter the overall appearance of the helmet.

These and other objects of the invention are accomplished by the fully break-away connection of a mask having a peripheral rod-like base portion over the generally central facial opening of a helmet and having downwardly extending opposed side portions and an upper central connecting portion. The mask/helmet connection is accomplished by attachment means having a plurality of spaced attachment points including an element having a forwardly directed undercut channel opening provided on each of said opposed side portions and said connected central portion. In alternate embodiments of the invention, the attachment points may either take the form of a plurality of spaced blocks disposed about the periphery of the facial opening of the helmet, or in the form of a single element extending about the periphery of said opening.

Other objects, features and advantages of the invention shall become apparent as the description thereof proceeds when considered in connected with the accompanying illustrative drawing.

DESCRIPTION OF THE DRAWING

In the drawing which illustrates the best mode presently contemplated for carrying out the present invention:

FIG. 1 is a side elevational view of a sports helmet incorporating one form of the present invention;

FIG. 2 is an enlarged view of a portion of FIG. 1;

FIG. 3 is a side sectional view taken along the line 3—3 of FIG. 2;

FIG. 4 is a perspective view showing the configuration of one of the blocks forming an attachment point whereby the face mask of the present invention may be attached to a helmet;

FIG. 5 is a side elevational view of an alternate form of the invention with the face mask attached to the helmet;

FIG. 6 is a view similar to FIG. 5 with the face mask portion removed from the helmet;

FIG. 7 is an enlarged view of a portion of FIG. 5; and

FIG. 8 is a sectional view taken along the line 8—8 of FIG. 7.

DESCRIPTION OF THE INVENTION

Turning now to the drawing and particularly FIGS. 1 through 4 thereof, one form of the invention is depicted. Therein, a helmet 10 is provided with a face mask such that the mask can be fully broken away from the helmet when separately grasped and a force having a significant forward and/or downward component applied thereto.

The helmet 10 is of generally conventional configuration and includes opposed downwardly extending side portions 14 and an upper central connecting portion 16 which cooperatively define a forward or facial opening 18 through which the wearer may observe and thereby participate in the game or sport being undertaken. The purpose of the mask 12 is, of course, to protect the wearer's face from injury as by contact with hand, arm, knee or foot portions of other participants in such sport. The mask 12 is of generally grid-like configuration and includes a peripheral rod-like base portion 20 configured so as to conform to portions of the helmet adjacent the opening 18 thereof. The mask 12 further includes a forwardly extending guard portion 21 to accomplish the above-stated purpose.

In order to attach the mask to the helmet, a plurality of connecting blocks are attached to the helment at spaced locations about the periphery of the opening 18. Such blocks are of various configurations dependent upon their position with regard to the helmet. Accordingly, the device includes at least a pair of side blocks 22 attached to each side 14 of the helmet 10. Each such side block 22 includes a pad 24 having an opening 26 provided therein and at the rear end thereof with an upwardly extending generally C-shaped head 28. The C-shaped head in conjunction with the pad 24 form a reduced dimension opening 30 for a longitudinally extending channel 32. A screw 34 or other fastening means is adapted to extend through the pad opening 26 directly into the side surface 14 of the helmet 10, and accordingly mount the side block 22 in position as shown in FIGS. 1 and 2.

The connecting means further includes front and corner face mask attachment blocks 36 and 38 respectively. In such regard, the corner blocks 38 include upper and lower components 40 and 42 respectively which cooperate to form a generally U-shaped longitudinally orientated channel 44 in which a corner 46 of the base portion 20 of the mask is adapted to be received. Similarly, the front block 36 includes head 48 and pad portion 50. Suitable holes are provided in both the components of the side block 38 and through the pad portion 50 of the front block 36 so as to permanently affix such members directly to the helmet 10 as in the case of side blocks 22.

The base portion 20 of the mask is generally of rod-like construction and accordingly exhibits a somewhat circular cross-sectional configuration. Portions of the face mask are adapted to be received in snap frictional engagement within the forwardly facing open channels of each of the connecting blocks 22, 36 and 38. The blocks are preferably each formed of a somewhat elastic or flexible material such as molded plastic resinous compositions, i.e. polyethylene or polypropylene, which provide a certain give to the head portions thereof. Accordingly, in this manner, the face mask 12 may be snap locked in the desired position to the helmet 10 by forcibly pushing the base portion 20 thereof rearwardly when so positioned on the helmet.

The face mask will be retained in such position unless it is forcibly grasped as by an opposing player and subjected to a force having a significant forward and/or downward component at which time the mask will be forced out of the various channels and completely break away from the helmet. It is contemplated that the extent of the undercut or reduced opening of the several channels may be varied such that the force necessary to break the mask away from the helmet can be varied according to the sport and the degree of expertness or strength of the player participants. Similarly, the materials from which the blocks are formed might also be varied so as to vary the force required to accomplish such break-away action.

Turning now to FIGS. 5 through 8 of the drawing, an alternate embodiment of the invention is disclosed wherein the attachment means by which the mask 12*a* thereof may be connected to the helmet 10 includes an elongated member 52 outwardly extending from outer surface portions of the helmet 10 and in effect extending about the periphery of the front opening 18 thereof. Such member 52 is affixed to the helmet as by fastening means such as the screws 54 shown. The overall configuration of the member 52 is somewhat U-shaped and exhibits forwardly facing side edge surfaces 56 and a similarly disposed front edge surface 58. Outwardly extending from each of such surfaces 56, 58 is at least one forwardly projecting headed member 60 which is adapted for frictional snap engagement with an open pocket 62 provided within the rearwardly extending edge 64 of the base portion 20*a* of the face mask 12*a*. The pockets 62 are spaced along the periphery of the base portion 20*a* in spaced relation conforming to the disposition of the headed members 60 about the periphery of the member 52.

It should thus be apparent that the pockets 62 roughly correspond to the recesses or channels 32 in the previous embodiment and accordingly a similarly frictional snap engagement may be provided by reason of the reduced extent of the lead-in opening 66 thereto. Also, while in the alternate embodiment depicted in FIGS. 5 through 8, the pockets are shown disposed in the base portion 20*a*, a variant construction thereof may include the pockets within the member 52 and the headed members rearwardly extending from the rear surface 64 of the base portion 20*a* without departing from the spirit of the invention disclosed herein. Furthermore, the spacing between member 52 and base portion 20*a* may be varied, and in some cases, the opposed surfaces thereof may contact each other so as to provide increased lateral and rear stability to the face mask 12*a*.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A safety device for use with a protective sports helmet in turn having downwardly extending opposed side portions and an upper central connecting portion forming a centrally disposed facial opening, comprising a mask adapted for disposition over said facial opening to protect the face of the wearer, said mask including a peripheral rod-like frame which has portions extending vertically along the outer surfaces of said side portions and then forwardly across the top front of said helmet whereby said frame extends generally around said facial opening, attachment means mounted on the outer surfaces of said side portions, said means comprising a pair of vertically spaced blocks on each side portion, said blocks each having grooves therein with reduced lead-in portions adapted to detachably snap-receive said frame, the bottom block on each side being adapted to receive said vertically extending portion adjacent the lower end thereof and the top block on each side having a curved groove configured to receive the corners where said vertical portions merge with said forward portion, said grooves all being at least partially exposed in a forward direction whereby said mask may be readily detached from said helmet in a forward direction by a pull thereon comprising a significant forward force component.

* * * * *